US006074531A

United States Patent [19]

Hultcrantz et al.

[11] Patent Number: 6,074,531

[45] Date of Patent: Jun. 13, 2000

[54] DEVICE IN A MEASURING STATION

[75] Inventors: Lars-Magnus Hultcrantz, Deje; Tord Olof Svanqvist; Bo Lennart Örtemo, both of Karlstad, all of Sweden

[73] Assignee: Valmet-Karlstad AB, Sweden

[21] Appl. No.: 09/038,336

[22] Filed: Mar. 11, 1998

Related U.S. Application Data

[60] Provisional application No. 60/049,314, Jun. 10, 1997.

[30] Foreign Application Priority Data

Mar. 11, 1997 [SE] Sweden ..... 9700861

[51] Int. Cl.[7] ..... D21F 7/06

[52] U.S. Cl. ..... 162/263; 162/253

[58] Field of Search ..... 162/252, 253, 162/263

[56] References Cited

U.S. PATENT DOCUMENTS

| | | | |
|---|---|---|---|
| 3,650,043 | 3/1972 | Overly et al. | 34/156 |
| 4,321,107 | 3/1982 | Page | 162/198 |
| 5,164,048 | 11/1992 | Bossen et al. | 162/272 |
| 5,233,195 | 8/1993 | Hellstrom et al. | 250/360.1 |
| 5,492,601 | 2/1996 | Ostermayer et al. | 162/198 |
| 5,745,244 | 4/1998 | Svanqvist et al. | 356/429 |

FOREIGN PATENT DOCUMENTS

WO 97/10382 3/1997 WIPO .

*Primary Examiner*—Christopher A. Fiorilla
*Attorney, Agent, or Firm*—Alston & Bird LLP

[57] ABSTRACT

A device in a measuring station in a paper or cardboard machine for manufacturing a paper or cardboard web, said measuring station being situated between two work stations and comprising a scanner with two measuring heads travelling to and fro across the web and between them defining a space through which the web passes, driven by drive members. According to the invention the device comprises a continuous, flexible support strip extending through said space between the measuring heads, transverse and parallel to the web from one edge to the other, and drive members for winding and unwinding the support strip onto or off rolls arranged at points outside each edge of the web, for displacement of the support strip transversely to the web in the same direction and at the same speed as the measuring heads. The support strip is provided with at least one through-opening to expose the web to at least one measuring transducer, the emitter and receiver units of which being situated in individual measuring heads or the same measuring head.

18 Claims, 3 Drawing Sheets

DEVICE IN A MEASURING STATION

CROSS-REFERENCE TO RELATED APPLICATIONS

This application claims the benefit of U.S. Provisional Application Ser. No. 60/049,314, filed Jun. 10, 1997.

FIELD OF THE INVENTION

The present invention relates to papermaking machines, and more particularly relates to a device in a measuring station in a paper or cardboard machine for manufacturing a paper or cardboard web.

BACKGROUND OF THE INVENTION

The performance of a paper machine, such as a tissue machine, is often limited by its drying section. Several factors in the drying section may cause a rupture in the web and the web produced may then have to be rejected due to unsatisfactory quality. The main factors affecting the efficiency of the machine's drying section are loss of time when there is no paper on the reeling drum and the quantity of paper that must be rejected after a rupture. In most machines which are run at high speed, the paper reel is ejected in the event of a rupture since it is difficult to rewrap a half-sized reel to continue reeling, and if it is too small the reel is rejected. One cause of web rupture is that when a web is running with no support between two consecutive sections in a paper machine, air currents will often cause turbulence and web flutter which sometimes results in the web breaking. Such air currents may come from the machinery, the layer of air at the boundary and the rotating drums in the paper machine. A section of the web draw in which the web runs without support is termed an "open draw".

In order to reduce web breakage it is known to stabilize or support the web by means of flutter suppressers along its draw. Such flutter suppressers may be in the form of plates or wings extending across the width of the predetermined web draw. When a web is to run along and slightly spaced from a flutter suppresser in the form of a plate, the boundary layer of air between the flutter suppresser and the web will be reduced and maintained. The tendency of the web to flutter will therefore decrease. Web stabilizers or flutter suppressing wings are described in U.S. Pat. No. 4,321,107 (Page) and U.S. Pat. No. 3,650,043 (Overly et al.). A section of the web draw where the web is supported is termed a "closed draw".

In the drying section of a paper machine the web usually passes a measuring station with a scanner for measuring properties such as moisture and basis weight. Scanners are described for instance in U.S. Pat. No. 5,164,048 (Bossen et al.) and U.S. Pat. No. 5,233,195 (Hellstrom et al.). The above-mentioned U.S. Pat. No. 4,321,107 states that a tissue-paper web runs from a Yankee-cylinder past a suppressing wing, through a scanner and then past a second suppressing wing. According to this patent specification the scanner forms an intermediate element between the suppressing wings. The part of the web draw where scanning occurs will therefore constitute an open draw. If a scanner is to be applied on a part of the web draw, scanning may not of course be impeded by any object such as a suppressing wing. The part of the web draw where the web passes a scanner will, however, have a greater tendency to web flutter and web rupture than the parts of the web draw where the web can be supported by a suppressing wing or similar element. The distance the web travels during passage of the measuring frame of the measuring station is of course relatively short, but it is still sufficiently long to be able to cause undesired flutter. Another drawback with the web flutter caused by the open draw is that measurement of the web properties will be less accurate.

SUMMARY OF THE INVENTION

The device according to the present invention is characterized in that it comprises a continuous, flexible support strip extending through the space between two measuring heads, transverse and parallel to the web from one edge to the other. Drive members are provided for winding and unwinding the support strip onto or off rolls arranged at points outside each edge of the web and for displacement of the support strip transversely to the web in the same direction and at the same speed as the measuring heads. The support strip is provided with at least one through-opening to expose the web to at least one measuring transducer, the emitter unit and receiver unit of which are situated in individual measuring heads or the same measuring head.

BRIEF DESCRIPTION OF THE DRAWINGS

The invention will be described in more detail in the following, with reference to the drawings showing a presently preferred embodiment.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
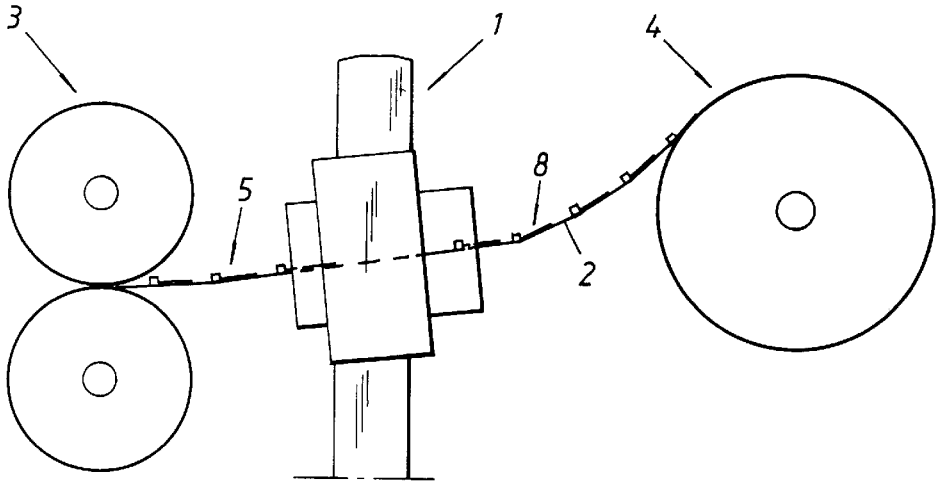
FIG. 1 is a side view of a part of a paper machine showing a measuring station placed between two work stations for a continuous paper web.
Figure 2:
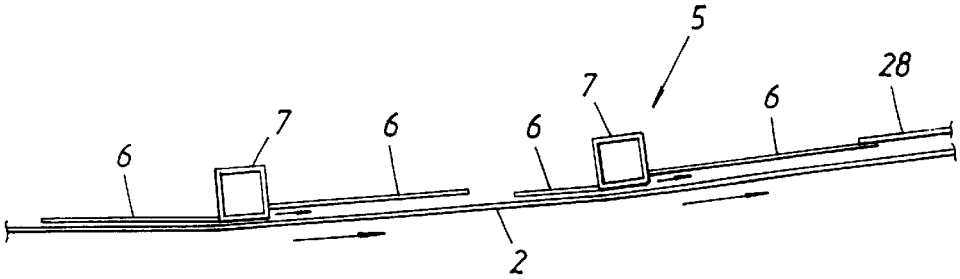
FIG. 2 is a side view showing a part of the web draw upstream of the measuring station, in greater detail.
Figure 4:
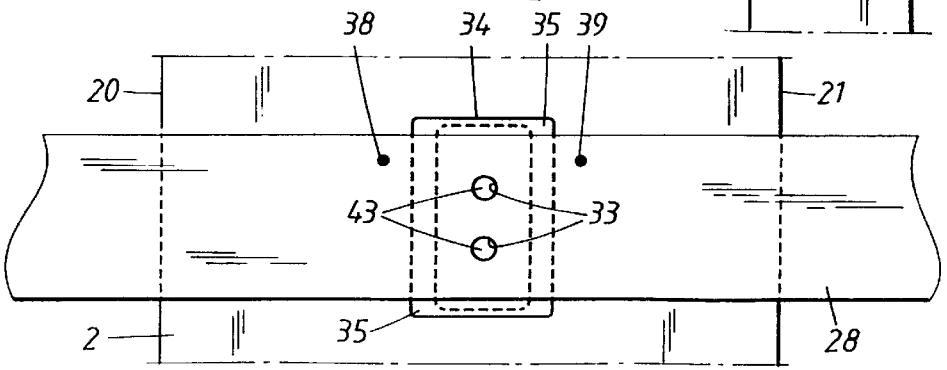
FIG. 4 is a top view of the web and a part of the scanner along the arrows A—A in FIG. 3.

FIG. 1 shows a measuring station 1 receiving a continuous paper web 2 with two longitudinal edges 20, 21 (FIG. 4). The web is delivered from a previous work station 3 such as a pair of calender rolls, and runs in a predetermined path of movement through the measuring station 1 where measuring is performed. From the measuring station 1 the web continues to the next work station 4, such as a reel-up. As can be seen in FIGS. 1 and 2 the paper web is delivered to the measuring station 1 via a support member 5 forming a web-supporting or web-carrying surface. The support member 5 comprises a plurality of plates 6 arranged one after the other which extend across the width of the web, and tubes 7, also extending across the width of web. The plates 6 are mounted close to the predetermined path of movement of the web. The tubes 7 are placed as connecting elements between two consecutive plates 6, and each tube 7 extends in vertical direction slightly past the plane of the plate situated downstream. When the paper web 2 passes one of the tubes 7, therefore, the transition between the tube 7 and the plate 6 located downstream will create a zone with partial pressure which will draw the web 2 towards the plate, thus improving adhesion between the web and the surface supporting the web.

In order to stabilize the web 2, and particularly for the purpose of threading paper through the machine, the tubes 7 are connected to a compressed air source and are provided with oblong slits or openings (not shown) facing the direction of movement of the web 2. As is clear from FIG. 2 showing a part of the web draw between the calender rolls 3 and measuring station 1, compressed air is fed out of the slits or openings in the direction of movement of the web 2. The flow of compressed air will then follow the web-supporting surface and run between the web 2 and the web-supporting surface. The flow of compressed air will accompany the web 2, helping it to move forward. Between the web 2 and the supporting surface the air flow will form a layer of air with reduced static pressure which will stabilize the web 2 against flutter. The web passes from the support member 5, through the measuring station, to a support member 8 located downstream and forming a web-supporting surface. The support member 8 resembles the support member 5.

Figure 3:
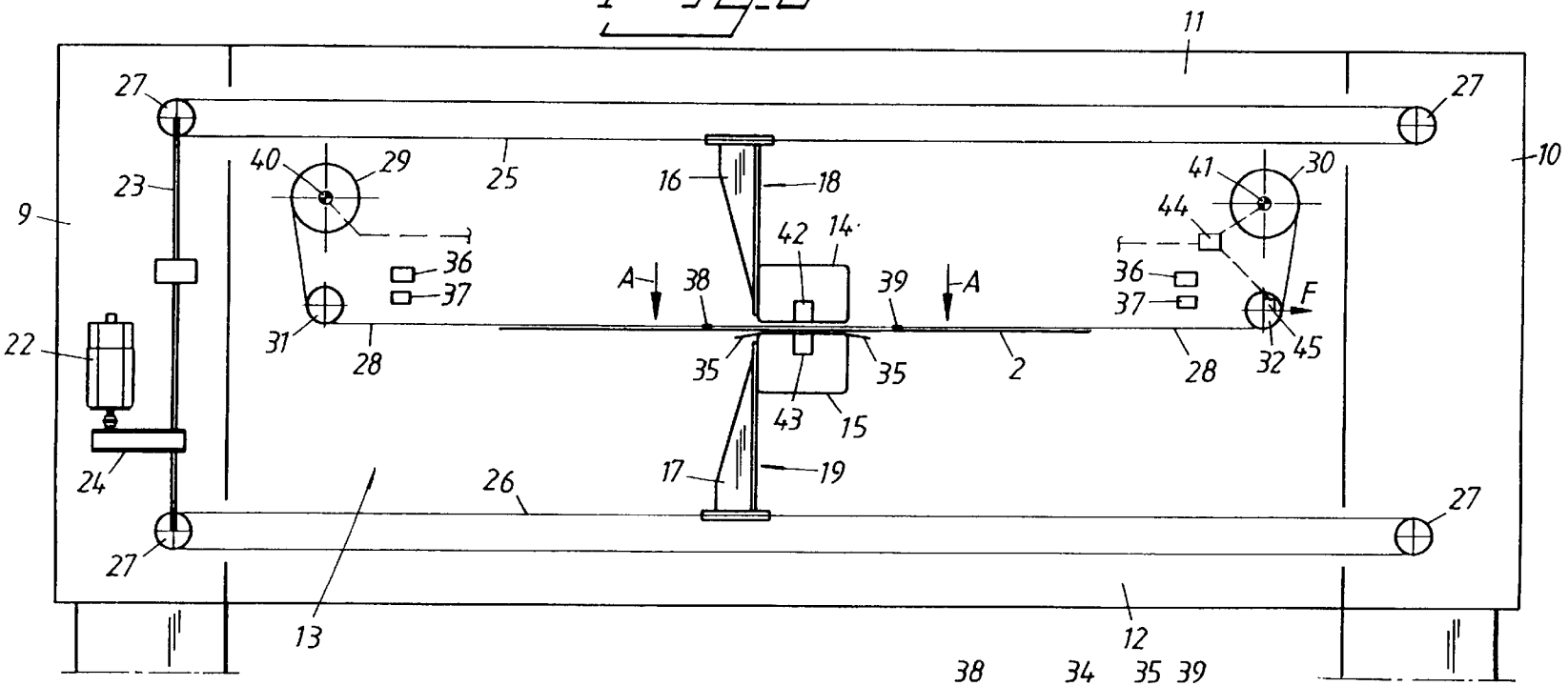
FIG. 3 shows the measuring station according to FIG. 1 seen in the direction of the machine.

As can be seen best in FIG. 3, the measuring station 1 comprises a stand which, in the embodiment shown, comprises two vertical side beams 9 and 10 joined together by means of a horizontal top beam 11 and a horizontal bottom beam 12. These beams thus form a rectangular open frame and the web 2 passes through the opening 13 therein.

The measuring station 1 comprises a scanner having two cooperating measuring heads 14, 15 disposed vertically one above the other at a predetermined distance from each other so that a space is formed between their flat horizontal surfaces facing each other, through which space the web 2 runs a short distance from said flat surfaces of the measuring heads. The measuring heads 14, 15 are provided with one or more measuring transducers in order to measure various properties of the paper web 2, such as sheet thickness, moisture content, basis weight, etc.

The measuring station 1 also comprises two cantilevers 16, 17, each supporting a measuring head 14, 15, respectively, and being movably journalled in the top beam 11 and bottom beam 12, respectively, along a horizontal rail (not shown). Each cantilever 16, 17 with its measuring head 14, 15, respectively, thus forms a movable, carriage-like unit 18, 19.

The measuring station 1 also comprises drive means for moving the carriages 18, 19 carrying the measuring heads 14, 15. In the shown preferred embodiment the drive means comprise a common drive source for the two carriages 18, 19, said drive source consisting of a motor 22 journalled on one side of die beam 9. The drive means comprise a transmission with a vertical, rotatably journalled driving rod 23, driven by the motor 22 via a coupling 24, and upper and lower endless driving belts 25, 26 running in the top beam 11 and bottom beam 12, respectively and round wheels 27 journalled in the side beams 9, 10. The vertical driving rod 23 is joined at its upper and lower ends to the wheels 27 so that the rotary movement of the driving rod 23 is transmitted to the wheels 27 to drive the belts 25, 26 at exactly the same speed. The cantilevers 16, 17 are firmly secured to the driving belts 25, 26 so that the measuring heads 14, 15 will be moved synchronously with each other, transversely to and fro across the web 2 as the motor 22 changes driving direction.

In the embodiment shown the measuring heads have two measuring transducers and each measuring transducer comprises an emitter unit 42 situated in the upper measuring head and a receiver unit 43 situated in the lower measuring head, these two units always being vertically aligned with each other thanks to the synchronous movement of the measuring heads 14, 15. The measured values obtained are processed by means of known technology not dealt with here.

The invention relates to a device in a measuring station 1 of the type described above, for instance, said device comprising a continuous, flexible support strip 28 extending through the space between the measuring heads in a direction transverse to the web 2 and so that the support strip 28 is situated immediately above and parallel with the web 2. A roll 29, 30 is rotatably arranged in the vicinity of each side beam 9, 10. The ends of the support strip 28 are attached to the two rolls 29, 30 for alternate winding onto and unwinding from the rolls 29, 30. Copending U.S. patent application Ser. No. 08/689,467, now U.S. Pat. No. 5,745,244, and assigned to the assignee of the present invention, discloses a support strip on rolls which is directly connected to one of the measuring heads. Accordingly, as that measuring head is moved, the support strip is also caused to move.

The present invention can be more easily retrofitted to existing measuring stations without driving the support strip with the measuring head with the aid of drive means 40, 41 so that the support strip 28 acquires the same direction of movement and exactly the same speed as the measuring heads 14, 15. The drive means for the support strip 28 are separate from the drive means for the measuring heads 14, 15 but the two systems are synchronized so that the support strip 28 and the measuring heads 14, 15 are driven at exactly the same speed, the relative speed between them thus being zero. The parallel extension of the support strip 28 with and across the web is assured by two deflection rollers 31, 32 around which the support strip 28 passes during its movement up and down from the winding and unwinding rolls 29, 30. The deflection rollers 31, 32 are situated in a common plane and are vertically below the winding and unwinding rolls 29, 30. It will be understood that the distance between the deflection rollers 31, 32 is slightly greater than the width of the web 2 to allow sufficient space for the carriages 18, 19 in their end positions when the measuring transducers are situated outside the edges 20, 21 of the web 2.

Figure 5:
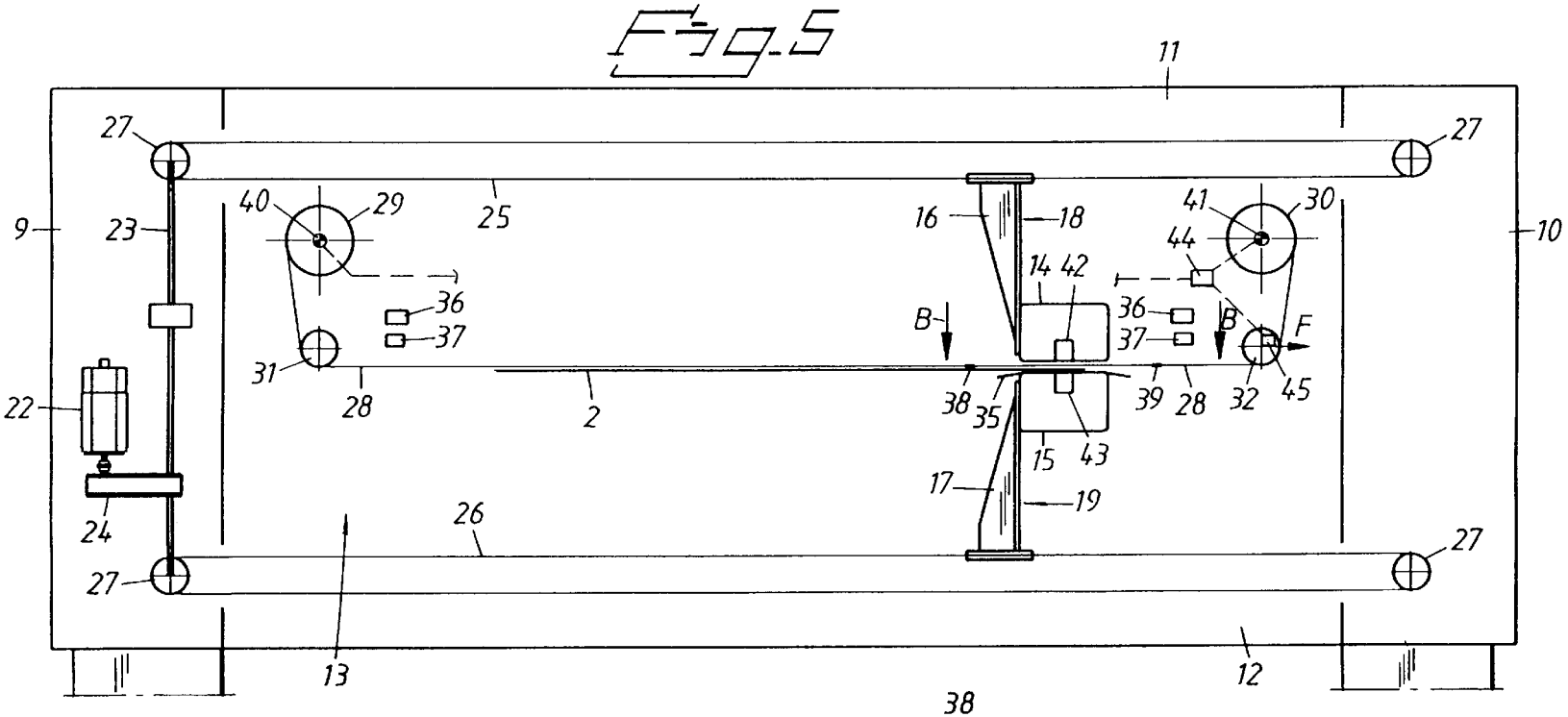
FIG. 5 shows the measuring station according to FIG. 1 with the measuring heads of the scanner near an end position.
Figure 6:
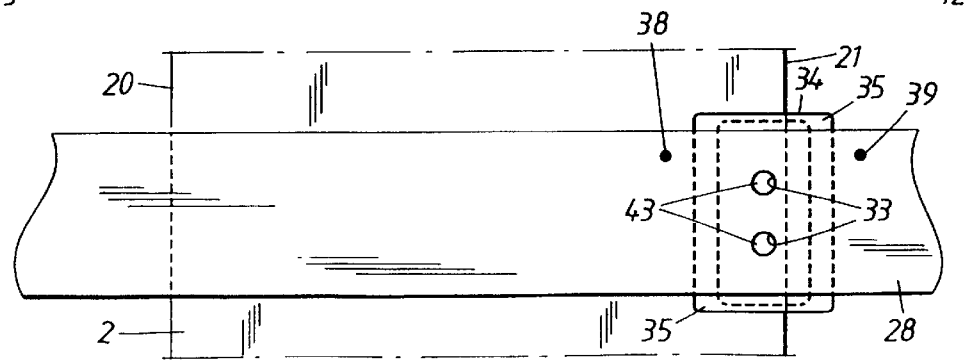
FIG. 6 is a top view of the web and of a part of the scanner along the arrows B—B in FIG. 5.

The device suitably includes a control circuit for controlling the tension in the support strip 28 to ensure that the support strip 28 has the desired straight draw, parallel with the web 2. The control circuit has a regulator 44 and a measuring transducer, suitably comprising a load cell 45 which detects the tension in the support strip 28. The tension (measured value) in the support strip 28 measured by the load cell is compared in the regulator 44 with a set value, i.e. a predetermined value for the tension which represents said desired straight draw of the support strip 28. As shown in FIGS. 3 and 5, the load cell may be arranged at the deflection roller 32 close to the side beam 10 on the right side of the figures. The load cell senses a force F corresponding to the tension appearing in the support strip at the time of measuring. When the force F decreases, for instance, the load cell emits a signal to the regulator which, after comparison with the set value, emits a signal to the relevant drive means 40 or 41 to retard the roller 29 or 30 from which the support strip is being unwound.

Said drive means may advantageously comprise servomotors with braking function. Alternatively, one roller may be driven by a servomotor and the other by a suitable spring which is placed under tension when the support strip is driven in one direction of the servomotor, whereupon the spring force thus built up is responsible for pulling the support strip back in the other direction.

The support strip 28 is provided with one or more openings 33 within the (section situated in the space) between the measuring heads 14, 15. Each opening 33 is aligned with at least one measuring transducer 42, 43 of the measuring heads. In the embodiment shown the measuring heads 14, 15 include two measuring transducers, as mentioned above, and the support strip 28 is provided with a circular opening 33 for each measuring transducer. In other words, the openings 33 are arranged to expose the web 2 to the measuring transducers so that their function is in no way disturbed. The dimension of each opening 33 is as small as possible in order to minimize any collection of dust on the measuring heads, but sufficiently large to permit free passage of measuring signals from the measuring transducers.

The lower measuring head 15 comprises a plate 34 which is extended in both directions of movement of the support strip in order to form two downwardly directed parts 35, ensuring that the web 2 is correctly guided to the upper side of the plate 34 (said upper side corresponding to said surface of the lower measuring head 15 which defines the space between the measuring heads).

The measuring heads 14, 15 are suitably pivotably mounted on their cantilevers 16, 17 so that their facing surfaces can be given an inclination in relation to the horizontal plane which corresponds to the inclined draw of the web when it passes the measuring station 1. Similarly, the winding and unwinding rolls 29, 30 and deflection rollers 31, 32 are suitably journalled in a house (not shown) which is pivotably journalled on the inner side of the side beams 9 and 10, respectively, about a horizontal shaft, so that the houses and thus also the support strip 28 can be given the same inclination as the measuring heads 14, 15, the support strip 28 thus being aligned parallel to the web.

The distance covered by the measuring heads 14, 15 is sufficient to allow scanning of the whole width of the web 2 before the measuring heads stop at the end positions and then return in the opposite direction. The measuring station 1 includes two limit switches 36 which sense the position of the upper measuring head 14 and emit a signal to the motor 22 to stop and reverse its drive direction. Similarly, the measuring station includes two limit switches 37 which sense suitable marks 38, e.g. metal tabs arranged at predetermined points on the support strip 28, whereupon a signal is emitted to the drive means in question to stop the support strip 28 simultaneously with the measuring heads and in the desired end position so that the openings in the support strip are still aligned with the measuring transducers of the measuring heads.

Some form of control device is advisable in order to ensure that the support strip 28 really does move at the same speed as the measuring heads 14, 15 while the scanner is in operation, and that therefore the openings 33 of the support strip 28 are aligned with the measuring transducers. A first pulse emitter may be arranged, for instance, at the upper wheel 27 near the side beam 9 on the left side in the drawings, and a second pulse emitter at the left deflection roller 31, these pulse emitters comparing pulses with each other and effecting correction of the speeds of the measuring heads and support strip should they have been recorded as different through deviation of the two pulse measurements.

The width of the support strip 28 is suitably somewhat greater than the distance between the stationary support members 5, 8 arranged upstream and downstream, so that the support strip is in sliding contact with the nearest plates 6 thereof, whereupon the support strip 28 overlaps these from above (see FIG. 2) and from below, at its edges situated upstream and downstream, respectively.

During passage of the web 2 through the measuring station, the web 2 will be supported and carried by the support strip 28 and possibly further stabilized by an air flow supplied from the tube 7 immediately upstream of the measuring heads 14, 15, said air flow passing between the support strip 28 and the web 2. The entire path of movement of the web 2 through the measuring station 1 thus forms an unbroken closed draw and yet the measuring transducers on the measuring heads will not be impeded by any object between them and the moving paper web.

The invention thus comprises arranging an unbroken closed draw for a moving fibre web 2 through a measuring station 1 by means of a support strip 28 forming a web-supporting and web-carrying surface which will support and carry the fibre web and yet not impede the measuring transducers of the measuring heads.

The device according to the invention reduces the occurrence of web ruptures and improves accuracy in scanning or measuring.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A measuring station in a machine for manufacturing a continuous fibrous web, said measuring station comprising:

a stand;

a scanner supported on said stand and having at least one head positioned adjacent the web for measuring a property of the web as the web travels by the at least one head;

a drive source for moving the at least one head back and forth across the web in a cross-machine direction;

a support strip extending in the cross-machine direction and positioned between said scanner and the fibrous web, said support strip defining at least one through-opening aligned with the at least one head to expose a corresponding portion of the web to the at least one head; and at least one drive member for displacing the support strip back and forth across the web independently of the at least one head but in the same direction and at the same speed such that the at least one through-opening remains aligned with the at least one head and measurements can be made across the width of the web.

2. A measuring station as claimed in claim 1 further comprising a roll on either side of the web and wherein the support strip is flexible and wound onto one of the rolls and off of the other roll as the at least one drive member displaces the support strip.

3. A measuring station as claimed in claim 2 wherein the at least one drive member comprises a servomotor having a braking function for rotating one of the rolls and winding the support strip thereon.

4. A measuring station as claimed in claim 3 further comprising two servomotors having a braking function wherein each of said servomotors is connected to a respective roll for winding the support strip thereon.

5. A measuring station as claimed in claim 1 further comprising a deflection roller arranged on each side of the web, the axes of said deflection rollers being arranged in the same plane, said plane being disposed above the web so that the support strip runs around the deflection rollers and extends in a straight path of movement between the deflection rollers immediately above the web.

6. A measuring station as claimed in claim 5 further comprising a control circuit for controlling the tension in the support strip to ensure that the support strip between the deflection rollers is straight and taut, said control circuit comprising a load cell arranged at one of the deflection rollers to measure the tension in the support strip, the control circuit being arranged to influence the at least one drive member in the event of deviation in the tension from a predetermined value in order to control the support strip tension.

7. A measuring station as claimed in claim 1 wherein said scanner further comprises an upper head arranged above the web and a lower head arranged below the web which move in tandem back and forth across the web.

8. A measuring station as claimed in claim 7 wherein the support strip is positioned between the upper head and the web, and wherein the lower head further comprises a plate arranged on the upper side thereof and extending therefrom in both directions of movement of the support strip to define two downwardly directed parts ensuring that the web is correctly guided.

9. A measuring station as claimed in claim 7 wherein the upper head includes one of an emitter unit and a receiver unit and the lower head includes the other of the emitter unit and receiver unit.

10. A measuring station as claimed in claim 1 wherein the support strip includes a pair of adjacent through-openings and the at least one scanner head includes an emitter unit aligned with one through-opening and an receiver unit aligned with the other through-opening.

11. A measuring station as claimed in claim 1 further comprising a stationary support plate upstream of the at least one scanner head and a stationary support plate downstream of the at least one scanner head wherein opposed edge portions of the support strip overlap the support plates.

12. A support device as claimed in claim 1 wherein the support strip includes a plurality of adjacent through-openings.

13. A support device in a measuring station having a scanner with a head for measuring a property of a continuous fibrous web as the head moves across the web in a cross-machine direction, said support device comprising:

a support strip extending in the cross-machine direction and positioned between the scanner and the fibrous web, said support strip defining at least one through-opening aligned with the head to expose a corresponding portion of the web to the head; and at least one drive member for displacing the support strip back and forth across the web independently of the head but in the same direction and at the same speed such that the at least one through-opening remains aligned with the head and measurements can be made across the width of the web.

14. A support device as claimed in claim 13 further comprising a roll on either side of the web and wherein the support strip is flexible and wound onto one of the rolls and off of the other roll as the at least one drive member displaces the support strip.

15. A support device as claimed in claim 14 wherein the at least one drive member comprises a servomotor having a braking function for rotating one of the rolls and winding the support strip thereon.

16. A support device as claimed in claim 15 further comprising two servomotors having a braking function wherein each of said servomotors is connected to a respective roll for winding the support strip thereon.

17. A support device as claimed in claim 13 further comprising a deflection roller arranged on each side of the web, the axes of said deflection rollers being arranged in the same plane, said plane being disposed above the web so that the support strip runs around the deflection rollers and extends in a straight path of movement between the deflection rollers immediately above the web.

18. A support device as claimed in claim 17 further comprising a control circuit for controlling the tension in the support strip to ensure that the support strip between the deflection rollers is straight and taut, said control circuit comprising a load cell arranged at one of the deflection rollers to measure the tension in the support strip, the control circuit being arranged to influence the at least one drive member in the event of deviation in the tension from a predetermined value in order to control the support strip tension.

* * * * *